US005129169A

United States Patent [19]

Aubichon

[11] Patent Number: 5,129,169

[45] Date of Patent: Jul. 14, 1992

[54] ATTACHMENT FOR SNOW REMOVAL

[76] Inventor: André Aubichon, 20 St.Charles, #2, Ile Bizard, Quebec, Canada, H9C 1L3

[21] Appl. No.: 620,779

[22] Filed: Dec. 3, 1990

[30] Foreign Application Priority Data

Aug. 31, 1990 [CA] Canada ..... 2024409

[51] Int. Cl.[5] ..... E01H 5/04; E02F 3/76

[52] U.S. Cl. ..... 37/231; 37/117.5; 37/DIG. 12; 172/817; 414/724

[58] Field of Search ..... 37/117.5, 241, 264, 37/280, DIG. 12, 281, 231; 172/817; 414/723, 724, 912; 403/13, 14

[56] References Cited

U.S. PATENT DOCUMENTS

| | | | |
|---|---|---|---|
| 3,599,355 | 8/1971 | Lockwood | 37/49 |
| 3,866,342 | 2/1975 | Cooper | 37/117.5 |
| 4,151,664 | 5/1979 | Maura | 37/DIG. 12 X |
| 4,189,854 | 2/1980 | Haynes | 414/724 |
| 4,208,812 | 6/1980 | Brownly | 37/280 |
| 4,255,884 | 3/1981 | Williams | 37/117.5 |
| 4,328,628 | 5/1982 | Thomas | 37/117.5 |
| 4,462,172 | 7/1984 | Caron | 37/117.5 X |
| 4,480,955 | 11/1984 | Andrews et al. | 37/117.5 X |
| 4,566,844 | 1/1986 | Campin | 37/117.5 X |
| 4,597,205 | 7/1986 | Guest | 37/241 |
| 4,707,936 | 11/1987 | Steinhoff | 37/264 |
| 4,741,116 | 5/1988 | Engle et al. | 37/280 |
| 4,790,084 | 12/1988 | Anderson et al. | 37/117.5 |
| 4,813,164 | 3/1989 | Morrell | 37/231 |
| 4,899,472 | 2/1990 | Winter | 37/264 X |

*Primary Examiner*—Randolph A. Reese
*Assistant Examiner*—Spencer Warnick
*Attorney, Agent, or Firm*—Robert Brouillette

[57] ABSTRACT

An attachment, to increase the efficiency of snow removal of vehicles equipped with a bucket, comprising, in one unit, a first side wing portion and a second side wing portion joined by a rear portion. This attachment is secured to the bucket by hooks, attached to the upper edge of the bucket, that engage slots on the rear portion of the attachment. This attachment can be secured to or released from the bucket of the vehicle solely by pivotal movements of the bucket without requiring the driver to leave his vehicle. The attachment increases the volumetric capacity of the bucket.

9 Claims, 2 Drawing Sheets

ATTACHMENT FOR SNOW REMOVAL

FIELD OF THE INVENTION

The present invention relates to an attachment for Vehicles equipped with a bucket to increase the efficiency of snow removal with such vehicles.

BACKGROUND OF THE INVENTION

A standard front end loader containing a conventional bucket generally does not adequately plow snow (the word "plow" as used herein refers to the action of pushing the snow in front of the loader). There have been several attempts to convert such vehicles into efficient snow plows through the attachment of blades on the front of the bucket.

Blades that are attached to the front of the bucket of front end loaders are described in U.S. Pat. Nos. 4,255,884 (Williams), 4,328,628 (Thomas), 3,866,342 (Cooper) and 3,599,355 (Lockwood). Although these attachments increase the efficiency of snow removal with such vehicles, they suffer the inherent disadvantage that the blade causes a lateral build up of snow, thus creating banks that can block driveways and cross streets.

There have also been attempts to increase the efficiency of snow plows by securing attachments or wings to the sides of the blade of the snow plow such as is described in U.S. Pat. Nos. 4,741,116 (Engle et al) and 4,707,936 (Steinoff). Such attachments successfully improve the efficiency of these snow plows and decrease the lateral buildup of snow. However, the deficiencies in these attachments are the tedious and time consuming methods required to secure these attachments to the blade of the snow plow.

OBJECTS OF THE INVENTION

It is an object of the present invention to provide an attachment for front end loaders and other vehicles equipped with a bucket to increase their efficiency of snow removal.

It is another object of the present invention whereby said attachment can be easily adapted to such existing vehicles.

It is yet another object of the present invention whereby the effort required to attach said attachment to said vehicle is minimal.

It is a further object of the present invention whereby the driver can attach said attachment without requiring the driver to leave his vehicle.

SUMMARY OF THE INVENTION

This invention relates to an attachment for front end loaders and other vehicles equipped with a bucket that can increase the efficiency of snow removal with such vehicles. This attachment, adapted to be attached to vehicles equipped with a bucket having a top portion adapted to receive a hook, also comprises a rear portion and two side wing portions and securing means located on said rear portion of said attachment for securing said attachment to said hook. This attachment is contained in a single unit and can be easily attached to and released from the front end loader without requiring the driver to leave his vehicle, the securing is possible by simple rotation of the bucket, therefore considerable time is saved.

The side portions define channelling walls for directing snow toward the mouth of the bucket. More particularly, the attachment is composed of two side face plate extensions (side wing portions) that protrude from the outside of the bucket side face plates, then angle outwards, to increase the width of the bucket mouth, and then angle back to be parallel with the bucket side face plates, and extend forward to retain the snow and increase the volume of snow retained in the bucket and between the extended face plates while being piled.

These face plates are equipped with the necessary retaining tabs and reinforcing gussets. They are joined together by a rear top cross member and a front top spreader bar, with the necessary reinforcing between the rear cross member and the front spreader bar and face plates.

When the attachment are hooked on the bucket, the side plates become like an extension of a widened out bucket, without a bottom section.

With this attachment, the volumetric capacity of the bucket is increased, thus the necessary time to clear a given area is drastically reduced.

The basic idea of this invention is to clear given areas (parking lots) as fast as possible (in the shortest length of time possible). This is done by pushing the snow forward to a piling area. Once sufficient area is cleared, the operator may remove the attachment from the bucket, simply by grounding the unit, and rotating the bucket forward into the dump position, and then backing up. The attachment stays on the ground, and the operator may back away from it, then use the loader in the normal fashion to load the truck that will haul the snow to the regular disposal site, if necessary, or, the snow can be left where it was piled.

To attach the unit, the operator rolls the bucket forward to align the hooks into the securing members of the attachment, raises his bucket slightly and rolls it back and the attachment is in place, ready to work.

Further features and advantages of the invention will become more readily apparent from the following detailed description of a specific embodiment of the invention when taken in conjunction with the accompanying drawings.

DESCRIPTION OF A PREFERRED EMBODIMENT

Figure 1:
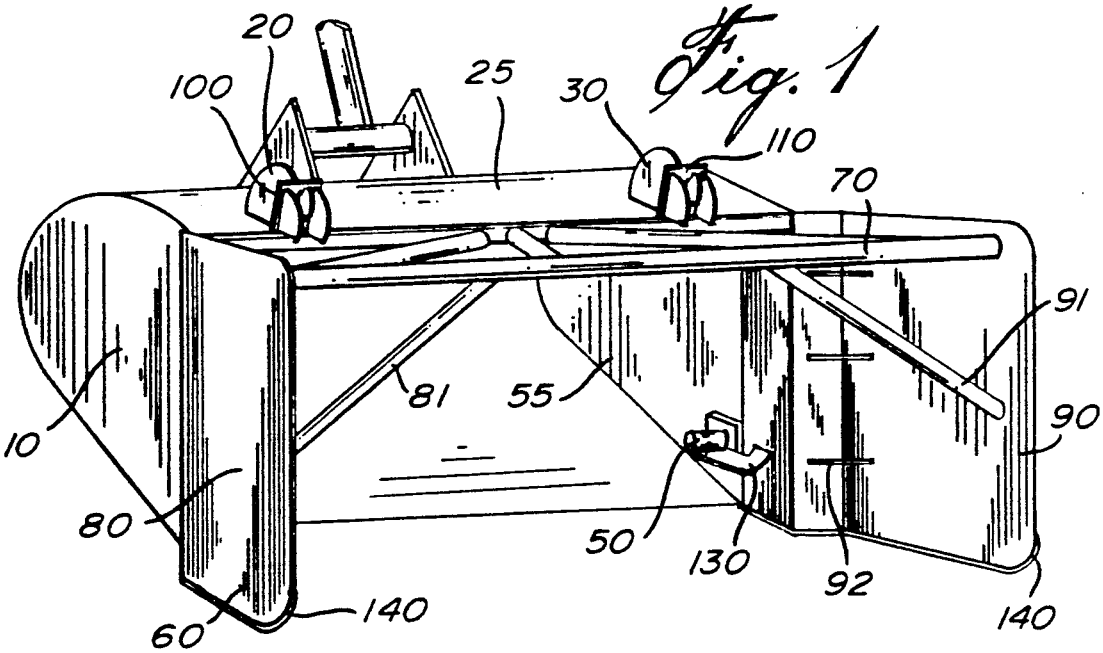
FIG. 1 is a perspective front view of the attachment secured to the bucket of a front end loader.
Figure 4:
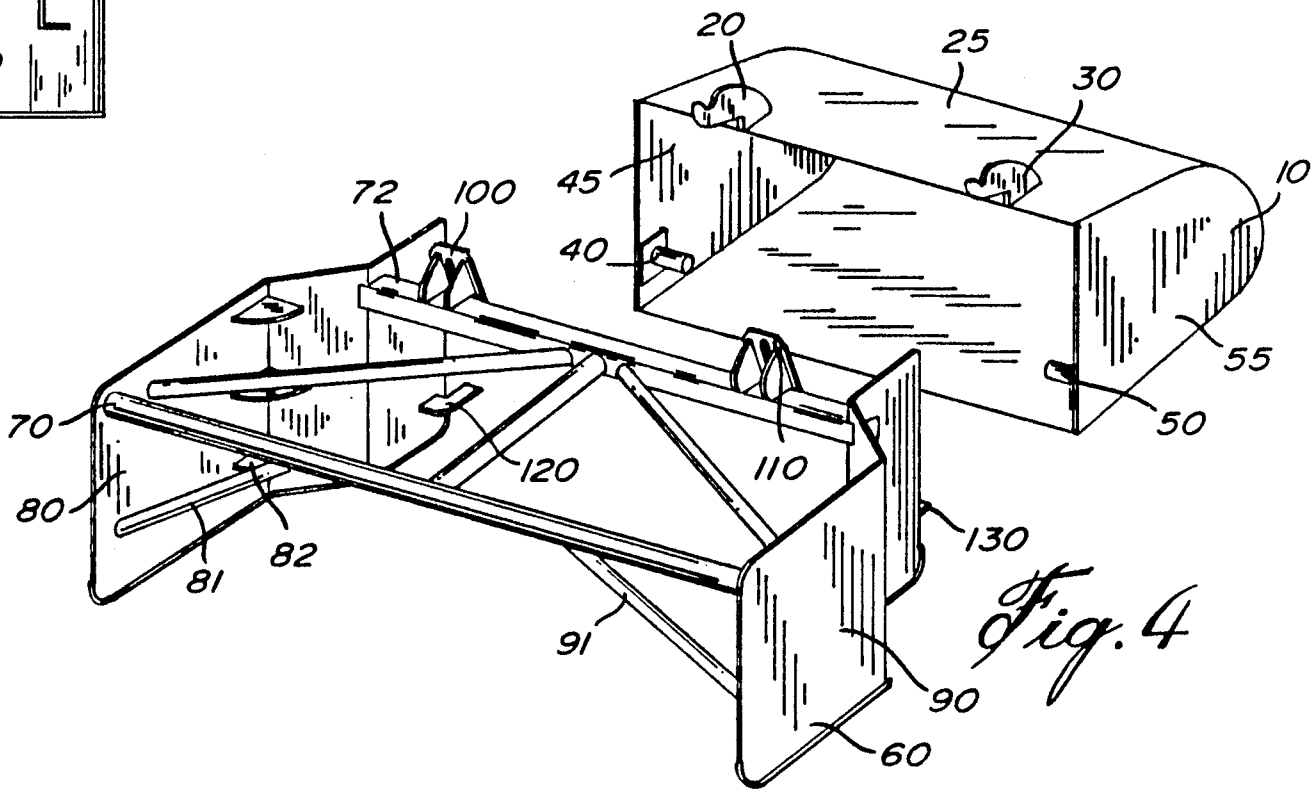
FIG. 4 is a perspective front view of the attachment and the bucket of a front end loader.
Figure 5:
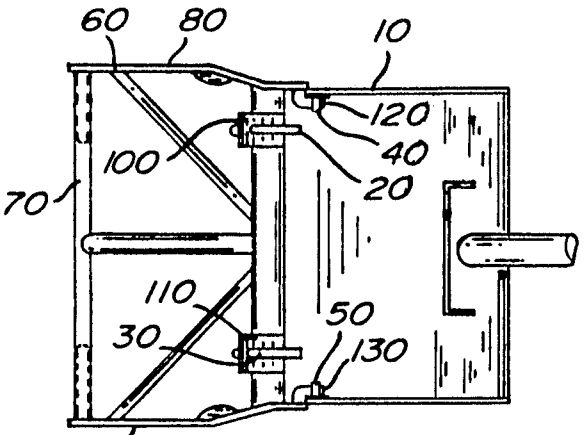
FIG. 5 is a top view of the attachment secured to the bucket of a front end loader.

Referring now to the drawings, FIGS. 1 and 4 show the bucket (10) of a typical front end loader. Two grasping means in the form of hooks (20,30) and two pins (40,50) have been welded or otherwise suitably attached to said bucket (10). The hooks (20) and (30) are located on the top outside face (25) of the bucket. The pins (40) and (50) are located on the bottom interior face of the sides (45) and (55) respectively of the bucket.

The attachment for the bucket (10) is indicated generally at (60). This attachment comprises in one unit: a rear top (72) portion and two side portions or wings (80) and (90).

This attachment is further supported by brackets (81) and (91) connected diagonally from the wings (80) and (90) to the top portion (70) as well as other reinforcing means shown generally at (82) and (92). The horizontal rear portion parallel (72) to the top portion (70) is provided with two slots (100) and (110). The side wings (80) and (90) are secured respectively with two tabs (120), shown in FIG. 4, and (130), shown in FIG. 1. As can been seen from FIG. 1, when this attachment (60) is secured to the bucket (10) of a front end loader, hooks (20) and (30) of the bucket pass through and are held by respectively aligned slots (100) and (110) on the attachment. As well, pin (50) sits on respective tab (130) and not shown in this perspective, pin (40) sits on respective tab (120). These pins and tabs further secure the bucket (10) in place. Also referring to FIG. 1, (140) illustrates a protective rod that is attached to the bottom of the side wings (80) and (90) in order to protect the side wings from wear.

Figure 2:
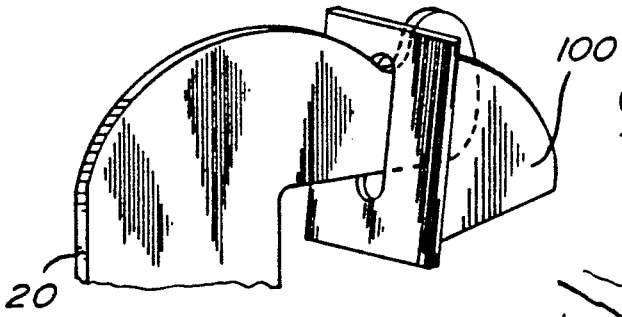
FIG. 2 is a side view of the hook engaged in the slot.
Figure 3:
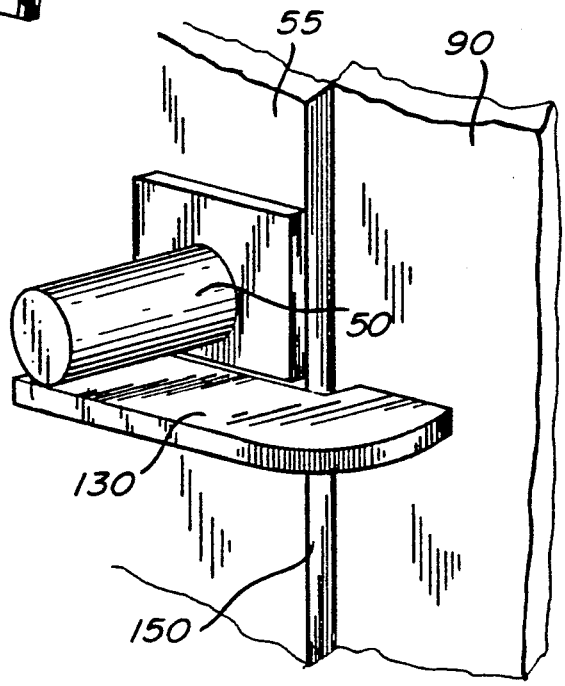
FIG. 3 is a side view of the tab and pin.

The engagement of the hooks (20) and (30), slots (100) and (110), tabs (120) and (130) and finally, pins (40) and (50) are shown in more detail in FIGS. 2 and 3. It is to be noted that a protective side plate can be secured at (150) shown in FIG. 3, in order to protect the side cutter of the bucket from damage.

This attachment can be easily mounted while the driver remains seated in the vehicle, the securing is possible by simple rotation of the bucket, therefore considerable time is saved. In order to mount the attachment (60) on the bucket (10), the driver maneuvers the vehicle into a position directly behind the attachment and operates the usual controls for tilting the bucket slightly downwardly and forwardly until the hooks (20) and (30) engage the respective slots (100) and (110). Then, the bucket is tilted upwardly, as this occurs the bottom edge of the bucket swings slightly upward until pins (40) and (50) rest on respective tabs (120) and (130). This inhibits further rotation of the bucket and secures the attachment into place.

While the above description refers to a specific embodiment of the invention, it is to be noted that other variations and modifications may also be made without departing from the principles of the invention as claimed.

Modifications of the side wings can include the replacement of the lower portion of the wings with other materials such as rubber, in order to increase the flexibility of the wings.

It is to be noted that the hooks, slots, pins and tabs can be secured directly to the bucket or attachment by various means, such as by welding. As well these pieces can be attached to intermediate pieces which are then secured to the bucket or attachment. For example, said hooks may be welded to a mounting plate which is, in turn, bolted or otherwise secured to the bucket. This allows the hooks to be detached from the bucket, for example, in the summer. As well, when the attachment is secured to larger vehicles, the hooks can be further supported by diagonally attached reinforcement gussets.

Further modifications of the invention may include altering the size of the attachment to correspond to the size of the bucket of the vehicle.

The attachment may also be made smaller in order to decrease its weight and make it more suitable for vehicles with less power or less lifting capabilities.

| LIST OF ELEMENTS | |
|---|---|
| 10 | is the bucket of a front end loader; |
| 20 and 30 | are hooks grasping means attached to the bucket; |
| 25 | is the top outside face of the bucket; |
| 40 and 50 | are pins attached to the bucket; |
| 45 and 55 | are the side interior faces of the bucket; |
| 60 | is the attachment; |
| 70 | is the front top portion of the attachment; |
| 72 | is the rear top portion of the attachment; |
| 80 and 90 | are the side wings of the attachment; |
| 81 and 91 | are supporting brackets for the attachment; |
| 82 and 92 | are reinforcing means for the attachment; |
| 100 and 110 | are slots secured to the attachment; |
| 120 and 130 | are tabs secured to the attachment; |
| 140 | is a protective rod secured to the attachment; |
| 150 | is the side cutter of the bucket. |

I claim:

1. An attachment for fixation to a vehicle equipped with a bucket for increasing the efficiency of snow removal, said bucket having a top portion, said attachment comprising a first side wing portion, a second side wing portion, a rear portion joining said first and second side wing portions, securing means located on said rear portion for grasping said top portion of the bucket and stabilizing means for inhibiting movement of said attachment relative to said bucket wherein said attachment can be fixed to or released from the vehicle solely by pivotal movement of said bucket, without requiring the driver to leave said vehicle, wherein said side wing portions are spaced apart and define channelling walls for directing snow toward the mouth of the bucket and wherein said stabilizing means comprises a plurality of tabs and a plurality of respective pins, said tabs being attached to said first and second side wing portions, at least one of said tabs being attached to said first side wing portion and at least one other tab being attached to said second side wing portion, said pins being attached to said bucket and said pins being disposed such that when the attachment is secured to said bucket each of said pins rests on a respective tab.

2. An attachment as defined in claim 1 wherein said side wing portions define channelling walls for increasing the width of the bucket mouth.

3. An attachment for fixation to a vehicle equipped with a bucket for increasing the efficiency of snow removal, said a first side wing portion, a second side wing portion, a rear portion joining said first and second side wing portions, securing means located on said rear portion for securing said attachment to said bucket, said securing means including one or more members, said members each defining a connection opening for engagement with and disengagement from a respective hook of the hook means, and stabilizing means for inhibiting movement of said attachment relative to said bucket wherein said securing means is engageable with and disengageable from said hook means solely by pivotal movement of said bucket, wherein said attachment can be attached to and released from the vehicle without requiring the driver to leave said vehicle, wherein said side wing portions are spaced apart and define channelling walls for directing snow toward the mouth of the bucket and wherein said stabilizing means comprises a plurality of tabs and a plurality of respective pins, said tabs being attached to said first and second side wing portions, at least one of said tabs being attached to said first side wing portion and at least one other tab being attached to said second side wing portion, said pins being attached to said bucket and said pins being disposed such that when the attachment is secured to said bucket each of said pins rests on a respective tab.

4. An attachment as define din claim 3 wherein said side wing portions define channelling walls for increasing the width of the bucket mouth.

5. An attachment as defined in claim 4 wherein said hook means comprises a plurality of said hook and said securing means includes a plurality of said members.

6. An attachment as defined in claim 3 wherein said hook means comprises one of said hooks and said securing means includes one of said members.

7. An attachment as defined in claim 3 wherein said hook means comprises a plurality of said hooks and said securing means includes a plurality of said members.

8. An attachment for fixation to a vehicle equipped with a bucket for increasing the efficiency of snow removal, said bucket having a top portion provided with hook means, said hook means comprising two upwardly extending hooks, said attachment comprising:

a first side wing portion, a second side wing portion, a rear portion joining said first and second side wing portions, securing means located on said rear portion for securing said attachment to said bucket, said securing means including two members, said members each defining a connection opening for engagement with and disengagement from a respective hook, and stabilizing means for inhibiting movement of said attachment relative to said bucket wherein said securing means is engageable with and disengageable from said hook means solely by pivotal movement of said bucket, wherein said attachment can be attached to and released from the vehicle without requiring the driver to leave said vehicle, wherein said side wing portions are spaced apart and define channelling walls for directing snow toward the mouth of the bucket and wherein said stabilizing means comprises a pair of tabs and a pair of pins, one of said tabs being attached to said first side wing portion and the other tab being attached to said second side wing portion, said pins being attached to said bucket and said pins being disposed such that when the attachment is secured to said bucket each of said pins rests on a respective tab.

9. An attachment as defined in claim 8 wherein said side wing portions define channelling walls for increasing the width of the bucket mouth.

* * * * *

UNITED STATES PATENT AND TRADEMARK OFFICE

CERTIFICATE OF CORRECTION

PATENT NO. : 5,129,169

DATED : July 14, 1992

INVENTOR(S) : André Aubichon

It is certified that error appears in the above-identified patent and that said Letters Patent is hereby corrected as shown below:

At column 4, line 51 of claim 3 should read as follows:

removal, said bucket having a top portion provided with hook means, said hook means comprising one or more upwardly extending hooks, said attachment comprising Signed and Sealed this Nineteenth Day of October, 1993

*Attest:*

Bruce Lehman

BRUCE LEHMAN

*Attesting Officer*

*Commissioner of Patents and Trademarks*